US006007648A

United States Patent [19]

Sullivan, Jr. et al.

[11] Patent Number: 6,007,648

[45] Date of Patent: Dec. 28, 1999

[54] LIQUID EXPLOSIVE COMPOSITION

[75] Inventors: John D. Sullivan, Jr., Edgewood, Md.; Peter A. Wade, Ardmore, Pa.; Abraham L. Turetsky, Baltimore, Md.

[73] Assignee: The United States of America as represented by the Secretary of the Army, Washington, D.C.

[21] Appl. No.: 09/030,520

[22] Filed: Feb. 23, 1998

[51] Int. Cl.[6] ..... C06B 25/00; C07C 205/00

[52] U.S. Cl. ..... 149/88; 149/2; 568/924; 568/948

[58] Field of Search ..... 149/88, 2; 568/924, 568/948

[56] References Cited

U.S. PATENT DOCUMENTS

| | | | |
|---|---|---|---|
| 3,301,724 | 1/1967 | Scott, Jr. | 149/89 |
| 3,797,392 | 3/1974 | Eckels | 149/89 X |
| 3,980,510 | 9/1976 | Ridgeway | 149/36 |
| 4,297,152 | 10/1981 | Frankel et al. | 149/88 |
| 4,332,744 | 6/1982 | Gilligan et al. | 149/88 X |
| 4,411,837 | 10/1983 | Gilligan et al. | 149/88 X |
| 4,486,251 | 12/1984 | Bell | 149/88 X |
| 4,621,149 | 11/1986 | Fukuoka et al. | 560/24 |

*Primary Examiner*—Peter A. Nelson

*Attorney, Agent, or Firm*—Paul S. Clohan, Jr.; U. John Biffoni

[57] ABSTRACT

An improved, liquid, explosive composition comprising nitromethane, a nitromethane sensitizer and an energetic compound. The energetic compound is selected from the group consisting of 4,5-dihyro-3-nitroisoxazole, 1,3-dinitropropane, trans1,2-dinitrocyclopropane and 1,1-dinitroethane.

16 Claims, No Drawings

LIQUID EXPLOSIVE COMPOSITION

GOVERNMENT INTEREST

The invention described herein may be manufactured, used and/or licensed by or for the United States Government.

BACKGROUND OF THE INVENTION

1. Field of the Invention

The present invention is directed to an improved liquid explosive composition. More specifically, the invention relates to an improved, liquid explosive composition containing a mixture of effective amounts of nitromethane, a nitromethane sensitizer (sensitizer) and an energetic compound.

2. Discussion of Prior Art

Explosive compositions comprising nitromethane and a sensitizer for the nitromethane are well known in the art. These compositions are formed by combining nitromethane with a sensitizing chemical compound as disclosed in U.S. Pat. Nos. 3,454,438, 3,309,251 and 3,239,395, or by exposing nitromethane to a sensitizing material as disclosed in U.S. Pat. Nos. 3,338,165 and 3,977,921.

Various chemical compounds serve as effective sensitizers for nitromethane. For example, U.S. Pat. Nos. 3,309,251 and 3,239,395 disclose liquid explosive compositions containing nitromethane sensitized with amines or polyamines such as diethylamine, triethylamine, ethanolamine, ethylenediamine and morpholine.

Likewise, non-chemical, air entrapping structures, such as resin micro balloons and polymeric foam, are effective nitromethane sensitizers. For example, U.S. Pat. No. 3,977,921 discloses a method for priming nitromethane with a open-celled polymeric foam and a blasting cap. Similarly, U.S. Pat. No. 3,338,165 discloses a gelled nitromethane based explosive sensitized with polymeric resin micro balloons.

Normally, liquid nitromethane based explosive compositions are converted into a semi-solid or gelled state by the addition of a gelling agent. This conversion increases the density and, therefore, the detonation pressure of the semi-solid or gelled compositions.

Although the semi-solid or gelled compositions have a higher detonation pressure than liquid compositions, they are not as effective in situations requiring a fluid material capable of conforming to any shape or structure. As a result, one must choose between the higher detonation pressure found in a semi-solid or gelled composition and the versatility of a liquid composition.

SUMMARY OF THE INVENTION

It is an object of the present invention to provide a powerful, nitromethane based, liquid explosive composition.

It is a further object of the present invention to provide a liquid nitromethane based explosive composition that can be mixed on site, when an explosive material is needed.

The present invention is an improved, liquid explosive composition comprising a combination of nitromethane, a sensitizer and an energetic compound. The addition of an energetic compound to a mixture of nitromethane and sensitizer forms an explosive composition that displays a significantly higher detonation pressure than the combination of nitromethane and sensitizer alone.

BRIEF DESCRIPTION OF THE PREFERRED EMBODIMENTS

The novel, liquid explosive composition of the present invention comprises a combination of nitromethane, a nitromethane sensitizer, and an energetic compound.

Nitromethane is the main component of the present invention. It is a singly nitrated alkane, commonly used in explosive compositions. Although nitromethane is naturally a very stable liquid compound, it becomes a very powerful and reliable explosive composition when sensitized.

Although any conventional nitromethane sensitizer may be used in the present invention including those disclosed in U.S. Pat. Nos. 3,239,395, 3,309,251, 3,338,165, 3,454,438 and 3,977,921 which are all herein incorporated by reference, the preferred nitromethane sensitzer is morpholine. Morpholine is a known and reliable amine sensitizer. However, its use is not intended to restrict the scope of the invention. Other sensitizers, such as diethylamine, triethylamine, ethanolamine, ethylenediamine, polymeric resin and polymeric foam may also be used.

An energetic compound selected from the group consisting of 4,5-dihydro-3-nitroxazole, 1,3-dinitropropane, trans-1,2-dinitrocyclopropane and, 1,1-dinitroethane is combined with the nitromethane and nitromethane sensitizer. The sensitizer portion of the mixture is kept rather low because it replaces the energetic materials. A preferable percentage range for the sensitizer is in the order of 3–10%. This novel composition forms a liquid explosive composition more powerful than sensitized nitromethane alone. The preferred volume ratio of the nitromethane/sensitizer/energetic compound composition is 72/4/24, respectively.

A comparison of the explosive strength of the nitromethane/sensitizer/energetic compound mixtures has been made and compared with the explosive strength of an equivalent amount, or proportionally equivalent amount, of nitromethane/sensitzer. The explosive strengths were measured with a test apparatus. The test apparatus consisted of a short plastic tube having an internal diameter of 20 mm. The plastic tube was perpendicularly attached to a polypropylene block. A test was conducted by pouring a specified, constant amount (25 ml) of a test mixture into the tube and inserting an initiator package into the open end. The initiator package contained a 5-gram booster pellet and 2-gram electric detonator. In general, the test was based on creating an explosion at the open end of the tube in order to develop a shock wave that, if sustained by detonation of the mixture, would form an impact crater in the polypropylene block. With such an arrangement, the power of the explosive material would correspond directly to the size of the crater produced. The results of the cratering tests are shown in the following tables.

Table 1. 4,5-Dihydro-3-nitroisoxazole Detonation Results

| Test No. | Mixture[1] (parts by volume) | Crater Volume[2] (ml) | Relative Size, sample/ref (%) |
|---|---|---|---|
| 6,8,24,15,25 | 23.75 NM/1.25 M OR Reference mixture | 20,16,20.9,24.5,21.3 average = 20.5 | 100% |
| 27 | 18 NM/1 MOR/6 DHI | 23.1 | 113% |
| 26 | 0 NM/0 MOR/25 DHI | 8.64 | 42% |

[1]NM = nitromethane, MOR = morpholine, DHI = 4,5-dihydro-3-nitroisoxazole
[2]Polypropylene Block The results shown in Table 1 indicate that an explosive composition 4,5-dihydro-3-nitroisoxazole in addition to nitromethane and a sensitizer (morpholine) produced a crater volume 13% larger than the crater volume produced by nitromethane and sensitizer alone.

TABLE 2

1,3-Dinitropropane Detonation Results

| Test No. | Mixture[3] (parts by volume) | Crater Volume[4] (ml) | Relative Size, Sample/ref (%) |
|---|---|---|---|
| 30,31,33,40 | 24 NM/1 MOR Reference Mixture | 26.9,23,29.6,20.3 average = 25.9 | 100% |
| 34 | 18 NM/1 MOR/6 DNP | 33.4 | 129% |
| 35 | 18 NE/1 MOR/6 DNP | no detonation | 0% |

[3]NM = nitromethane, MOR = morpholine, NE = nitroethane, DNP = 1,3-Dinitropropane
[4]Polyethylene Block The results shown in Table 2 indicate that the addition of 1,3-dinitropropane to nitromethane and sensitizer (morpholine) produces a crater volume 29% greater than the crater volume produced by a mixture of nitromethane and sensitizer alone. Furthermore, the results also suggest that the enhanced explosive power created by the addition of an energetic compound such as 1,3-dinitropropane does not apply to all classes of nitroparaffins (nitroethane and higher nitroparaffins) as shown by the lack of detonation of the composition containing nitroethane.

TABLE 3

Trans-1,2-Dinitrocyclopropane Detonation Results

| Test No. | Mixture[5] | Crater Volume[6] (ml) | Comments |
|---|---|---|---|
| 42 | Water, 4.0 ml reference blank | small dent, no crater in block | Initiator didn=t cause result |
| 37 | NM/MOR/DNCP[7] | 26.7 | large crater for only 4 ml of test composition |

[5]NM = nitromethane, MOR = morpholine, DNCP = 1,2-dinitrocyclopropane
[6]Polyethylene Block
[7]3.13 ml of 24 NM/1 MOR reference mixture dissolving 1.0005 g of 1,2-DNCP.

The results shown on Table 3 demonstrate that a very small amount of energetic compound, i.e, trans-1,2-dinitrocyclopropane, combined with a proportionate amount of nitromethane and sensitizer (morpholine), will produce a very powerful explosive. Although a comparison was not made directly with a 4 ml sample of nitromethane/sensitizer, the crater volume produced by only 4 ml of the new explosive composition was a size equal to 107% of the mean crater volume of the 25 ml sample. This shows that it is indeed a powerful explosive.

TABLE 4

1,1-Dinitroethane Detonation Results

| Test No. | Mixture[8] (parts by volume) | Crater Volume[9] (ml) | Relative Size, sample/ref (%) |
|---|---|---|---|
| 6,8,24,15,25 | 23.75 NM/1.25 M OR Reference mixture | 20,16,20.9,24.5,21.3 average = 20.5 | 100% |
| 28 | 18 NM/1 MOR/6 DNE | 32.8 | 160% |
| 29 | 16 NM/1 MOR/8 DNE | 31.5 | 154% |

[8]NM = nitromethane, MOR = morpholine, DNE = 1,1-dinitroethane
[9]Polypropylene Block This table illustrates significant crater volume increases observed with the mixture including 1,1-dinitroethane. Therefore, it is clear from the test results =shown in Tables 1, 2, 3 and 4 that the addition of 4,5-dihydro-3-nitroisoxazole, 1,3-dinitropropane, trans-1,2-dinitrocyclopropane or 1,1-dinitroethane to nitromethane and a sensitizer will produce an explosive composition significantly more powerful than sensitized nitromethane alone.

As will be apparent to one skilled in the art, various modifications can be made within the scope of the aforesaid description. Such modifications being within the ability of one skilled in the art form a part of the present invention and are embraced by the appended claims.

We claim:

1. A liquid explosive composition, comprising:

(a) nitromethane;

(b) a sensitizer; and (c) an energetic compound selected from the group consisting of 1,3-dinitropropane, trans-1,2-dinitrocyclopropane, 1,1-dinitroethane, and 4,5-dihydro-3-nitroisoxazole.

2. The explosive composition of claim 1, wherein said nitromethane and said sensitizer form a mixture of sensitized nitromethane.

3. The explosive composition of claim 1, wherein said sensitizer is selected from the group consisting of amines and polyamines.

4. The explosive composition of claim 3, wherein said sensitizer is selected from the group consisting of diethylamine, triethylamie, ethanolamine, ethylenediamine, and morpholine.

5. The explosive composition of claim 1, wherein said sensitizer is morpholine.

6. The explosive composition of claim 1, wherein said sensitizer comprises a mechanical sensitizer.

7. The explosive composition of claim 6, wherein said mechanical sensitizer is selected from the group consisting of resin microballoons and polymeric foams.

8. The explosive composition of claim 1, wherein the volume ratio of nitromethane/sensitizer/energetic compound is approximately 72/4/24, respectively.

9. The explosive composition of claim 1, wherein said sensitizer comprises morpholine and said energetic compound is 4,5-dihydro-3-nitroisoxazole.

10. The explosive composition of claim 9, wherein the volume ratio of nitromethane/morpholine/4,5-dihydro-3-nitroisoxazole is approximately 72/4/24, respectively.

11. The explosive composition of claim 1, wherein said sensitizer comprises morpholine and said energetic compound comprises 1,3-dinitropropane.

12. The explosive composition of claim 11, wherein the volume ratio of nitromethane/morpholine/1,3-dinitropropane is approximately 72/4/24, respectively.

13. The explosive composition of claim 1, wherein said sensitizer comprises morpholine and said-energetic compound comprises trans-1,2-dinitrocyclopropane.

14. The explosive composition of claim 13, wherein the volume ratio of nitromethane/morpholine/trans-1,2-dinitrocyclopropane is approximately 72/4/24, respectively.

15. The explosive composition of claim 1, wherein said sensitizer comprises morpholine and said energetic compound comprises 1,1-dinitroethane.

16. The explosive composition of claim 15, wherein the volume ratio of nitromethane/morpholine/1,1-dinitroethane is approximately 72/4/24, respectively.

* * * * *